US005657512A

United States Patent [19]

Graf

[11] Patent Number: 5,657,512

[45] Date of Patent: Aug. 19, 1997

[54] CIRCULAR COMB FOR A FIBER COMBING MACHINE

[75] Inventor: Ralph Graf, Freienbach, Switzerland

[73] Assignees: Graf & Cie AG, Raapperswil; Kratzen-und Maschinenfabrik And Maschinenfabrik Rieter AG, Wintbertur, both of Switzerland

[21] Appl. No.: 586,906

[22] PCT Filed: Aug. 4, 1994

[86] PCT No.: PCT/EP94/02591

§ 371 Date: Jan. 25, 1996

§ 102(e) Date: Jan. 25, 1996

[87] PCT Pub. No.: WO95/04848

PCT Pub. Date: Feb. 16, 1995

[30] Foreign Application Priority Data

Aug. 4, 1993 [DE] Germany ..... 43 26 205.8

[51] Int. Cl.[6] ..... D01G 19/22; D01G 19/10

[52] U.S. Cl. ..... 19/218; 19/233; 19/122

[58] Field of Search ..... 19/115 K, 217, 19/218, 233, 234, 122, 123, 124 B, 124 R

[56] References Cited

U.S. PATENT DOCUMENTS

| | | | |
|---|---|---|---|
| 4,896,401 | 1/1990 | Gasser | 19/233 |
| 5,131,117 | 7/1992 | Gallo et al. | 19/234 |

FOREIGN PATENT DOCUMENTS

| | | | |
|---|---|---|---|
| 0286993 | 10/1988 | European Pat. Off. | 19/234 |
| 1343572 | 10/1963 | France | 19/234 |
| 4124714 | 1/1993 | Germany | 19/234 |
| 673 290 | 2/1990 | Switzerland . | |
| 896504 | 5/1962 | United Kingdom | 19/234 |

*Primary Examiner*—C. D. Crowder
*Assistant Examiner*—Larry D. Worrell, Jr.
*Attorney, Agent, or Firm*—Jacobson, Price, Holman & Stern, PLLC

[57] ABSTRACT

A circular comb for a textile combing machine has a comb member formed around a part of the peripheral surface of an essentially cylindrical support member wherein a channel is formed between the comb member and the support member. For the purpose of reducing the dynamic pressure in front of the comb member generated when rotating the circular comb, the channel is provided with a cross-sectional form wherein the radial and/or axial width increases along the rotational direction of the comb.

3 Claims, 3 Drawing Sheets

CIRCULAR COMB FOR A FIBER COMBING MACHINE

BACKGROUND OF THE INVENTION

This invention relates to a circular comb comprising an essentially cylindrical support member being rotatable around its cylinder axis, and a comb member extending around a part of the peripheral surface of the support member and being rotatable therewith, wherein a channel and/or groove, extending essentially in a circumferential direction of the support member is arranged beneath the tines of the comb member in the support member and/or the comb member and/or between the support member and the comb member said channel and/or groove having a first orifice facing in a rotational direction of the support member and a second orifice facing in a direction opposite to the rotational direction of the support member.

Circular combs of the above general type are applied when working textile fibers in combing machines for removing short fibers and neps from the raw stock material having been previously subjected to a carding process. By this working process, the staple, i.e. the length of the fibers of the raw stock material is unified. For this purpose, the combing machine is generally positioned between the carding machine and the drafting frame in a fiber processing plant.

In the combing machine, a fiber tuft consisting of already carded fibers is held by nipper jaws and the tines of the circular comb pass through the likewise held fiber tuft. Thereafter, the fiber tuft is connected to an already combed fiber band. However, it is also possible to comb the fiber tuft after having it connected to the fiber band. The overall processing comprising engaging of the tines of the comb member into the fiber tuft, combing and connecting until the beginning of the engagement of the circular comb into a fiber tuft successively fed to the nipper jaws is hereinafter referred to as one "nip of the comb".

In ordinary circular combs, the support member is formed essentially cylindrical and the comb member extends around a part of the peripheral surface of the support member. During operation, the circular comb is rotated around its cylinder axis and with respect to the nipper jaws, it is positioned in such a manner that whereas the tines of the comb member may pass through the fiber tuft held by the nipper jaws, the support member does not represent a hinderance for connecting the combed fiber tuft with the fiber band when further rotating the circular comb. For this purpose, the circular comb is constructed so as to comprise a comb member attached to the cylindrical support member and expanding the support member in a radial direction, wherein a said comb member is provided with tines extending essentially radially outwardly. At the beginning of the development of circular combs, the tines were formed by round needles. By employing like circular combs a processing speed of 100 to 110 nips of the comb per minute could be achieved while simultaneously maintaining a satisfying combing effect. By the replacement of the round needles by saw-toothed wires, the processing speed could be raised up to 350 nips of the comb per minute without negatively effecting the combing effect. However, it has been shown that a further increase of the processing speed could not be achieved even when applying circular combs being provided with saw-toothed wires without effecting an insufficient combing effect.

A circular comb showing the features of the precharacterizing portion of claim 1 is known from CH-673 290 A5. In the circular comb disclosed in this document, an air conduit is disposed between the inner surface of the combing segment being provided with an airfoil profile and the outer surface of a cylindrical support member. By combining the air conduit with the airfoil type combing segment, in this known circular comb, a suction is generated in a region above the combing segment and a fiber tuft to be combed is fed to the tines of the comb. For this purpose, the air conduit is provided with a cross section increasing in a direction opposite to the rotational direction of the comb. For avoiding the formation of turbulences above the combing segment, generally effected by the above arrangement a comparatively thick projection is provided at the end of the combing segment facing in the rotational direction of the comb. For the purpose of ensuring that the teeth or needles of the combing segment engage into the fiber tuft as early as possible inspire of the dynamic pressure generated in front of the projection in the circular comb proposed in this document, .the teeth or needles are arranged in a position shifted backwardly with respect to the projection. Thus, a combing segment of a like circular comb has an overall length extending over that of the section provided with needles or teeth. Consequently, when using a like circular comb at a given processing speed, i.e. at a given number of nips of the comb per minute, the period of time in which the connection of the combed fiber tuft with the previously combed fiber band is reduced as compared to that available when employing an ordinary circular comb to thereby limit the processing speed achievable by the employment of circular combs disclosed in CH 673 290 A5.

SUMMARY OF THE INVENTION

In view of the above explained disadvantages of prior art circular combs, the object of the present invention is to provide a circular comb ensuring a satisfying removal of short fibers and neps even at high processing speeds.

According to this invention, in a circular comb of the above general type, this object is achieved by providing the channel and/or groove disposed beneath the tines of the comb member with a cross-sectional form wherein the radial and/or axial width increases along the rotational direction of the comb at least along a portion of the circumferential extension thereof.

By the above construction of the channel and/or groove, it is ensured that the surface of the combing segment facing in the rotational direction of the comb is comparatively small so that an effective reduction of the dynamic pressure usually generated in front of the combing segment, and representing the main problem when increasing the processing speed of circular combs, may be realized without resulting in the necessity of increasing the length of the combing segment of the circular comb to thereby increase the period of time available for connecting the combed fiber tuft with a fiber band at a given number of nips of the comb. Accordingly, the inventive circular comb enables to further increase the processing speed. It is noted that when employing the inventive circular comb, it is not necessary to generate the suction force above the combing segment because the above discussed reduction of the dynamic pressure achieved by the inventive construction of the channels and/or grooves already ensures a satisfying engagement of the tines of the comb into a fiber tuft resulting in a satisfying combing effect.

The inventive comb is realized in a particularly simple manner when the tines of the comb are formed by saw-toothed wire strips.

From the view point of the construction of the inventive comb, it is particularly preferred when the channel and/or groove is formed by a groove provided in a radially inwardly positioned peripheral surface of a base member of the comb member and/or a groove provided at the peripheral surface of the support member.

BRIEF DESCRIPTION OF THE DRAWINGS

The invention is further explained by referring to the accompanying drawings. In the drawings

DESCRIPTION OF THE PREFERRED EMBODIMENTS

Figure 1:
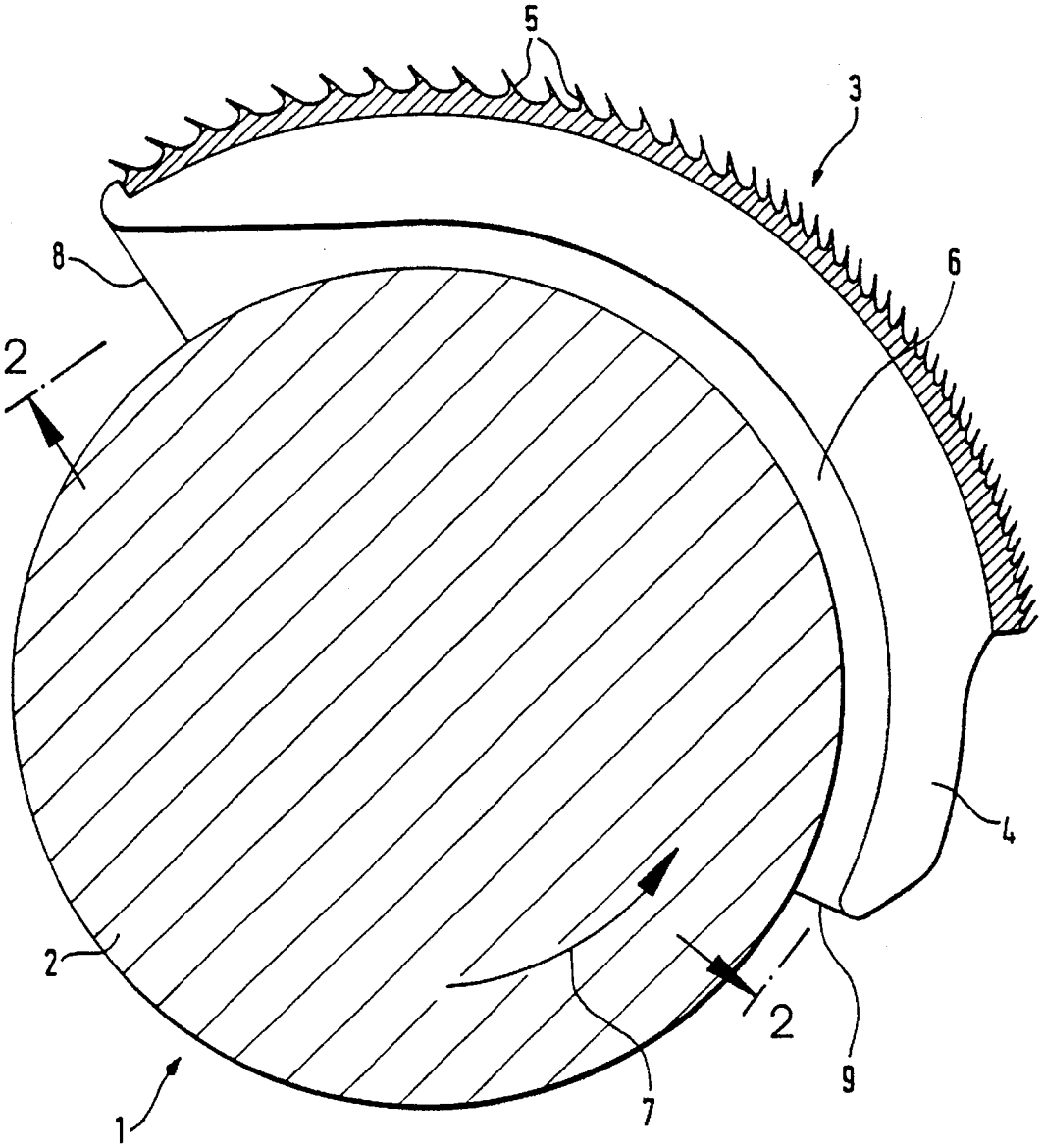
FIG. 1 shows a cross-sectional view of a first embodiment of the invention.

The circular comb 1 shown in FIG. 1 consists of a cylindrical support member 2 and a comb member 3 extending around a part of the peripheral surface of the support member 2. The comb member 3 comprises a base member 4 and tines 5 formed by saw-toothed wire strips. A channel 6 having an orifice 8 facing in a direction indicated by arrow 7 is disposed between the base member 4 of the comb member 3 and the support member 2. Further, the channel 6 is provided with a second orifice 9 at the rear end of the base member. The channel 6 is constructed so that its radial width increases in the rotational direction of the comb along a part of its overall lengthwise extension. As can be taken from FIG. 2, also the axial width of the channel increases in the rotational direction along a part of its lengthwise extension. As can be further taken from FIG. 2, the channel 6 is constituted by a groove 11 formed by ribs 10 provided at the base member 4 of the comb member 3.

When operating a like circular comb 1, air flowing against the front surface of the comb 3 is introduced into the channel 6 through the orifice 8 to thereby effect a pressure compensation between the air volume in front of the comb member 3 and that behind the comb member 3 by driving the air introduced into the channel 6 to the air volume behind the comb member 3 through the orifice 9. Further, by increasing the cross-sectional area of the channel 6 in the rotational direction thereof, the pressure increase in front of the comb 3 to be compensated by the above described air flow is effectively reduced by the decrease of the front face of the comb member effected thereby.

Figure 2:
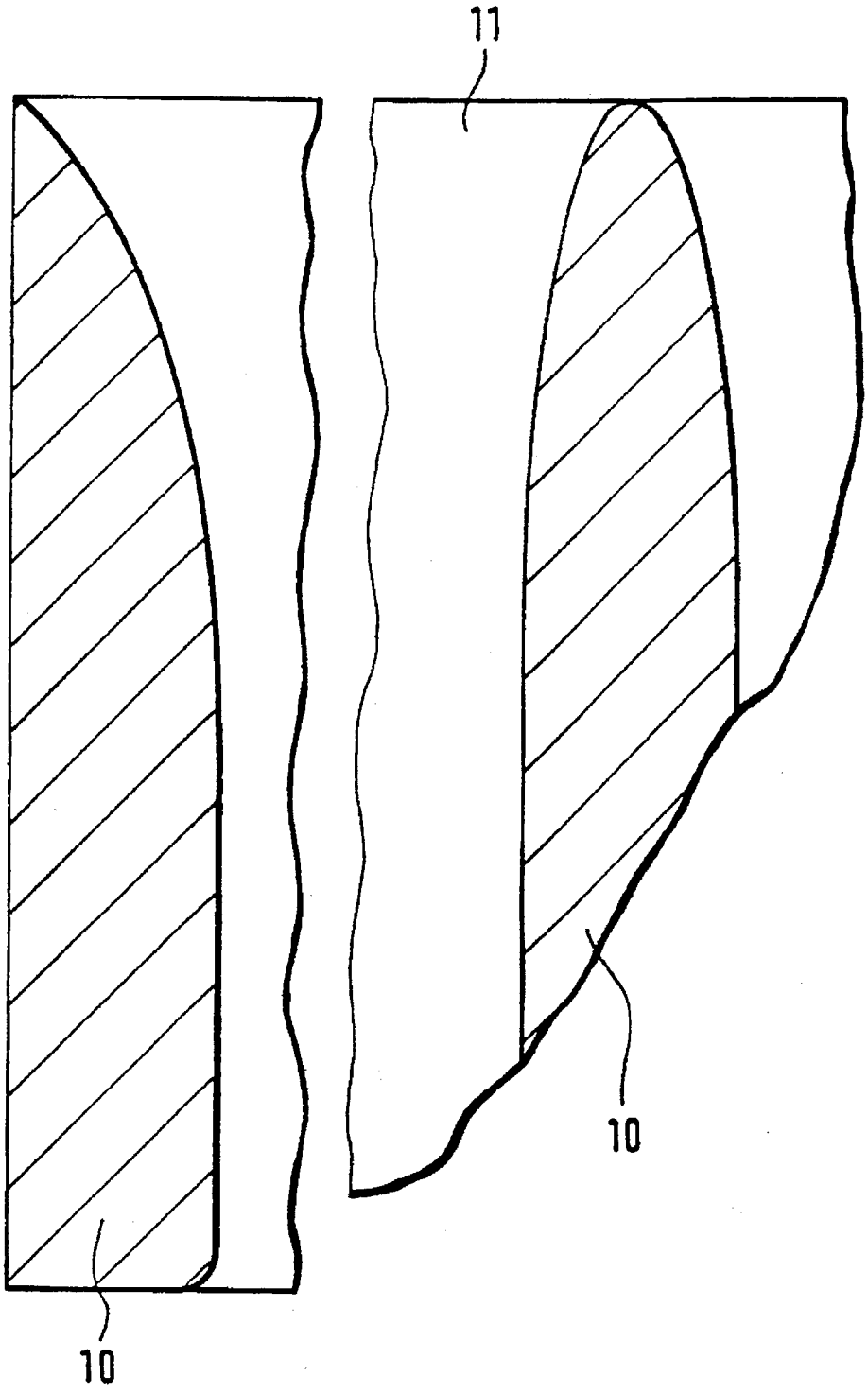
FIG. 2 shows a cross-sectional view taken along line 2—2 in FIG. 1.
Figure 3:
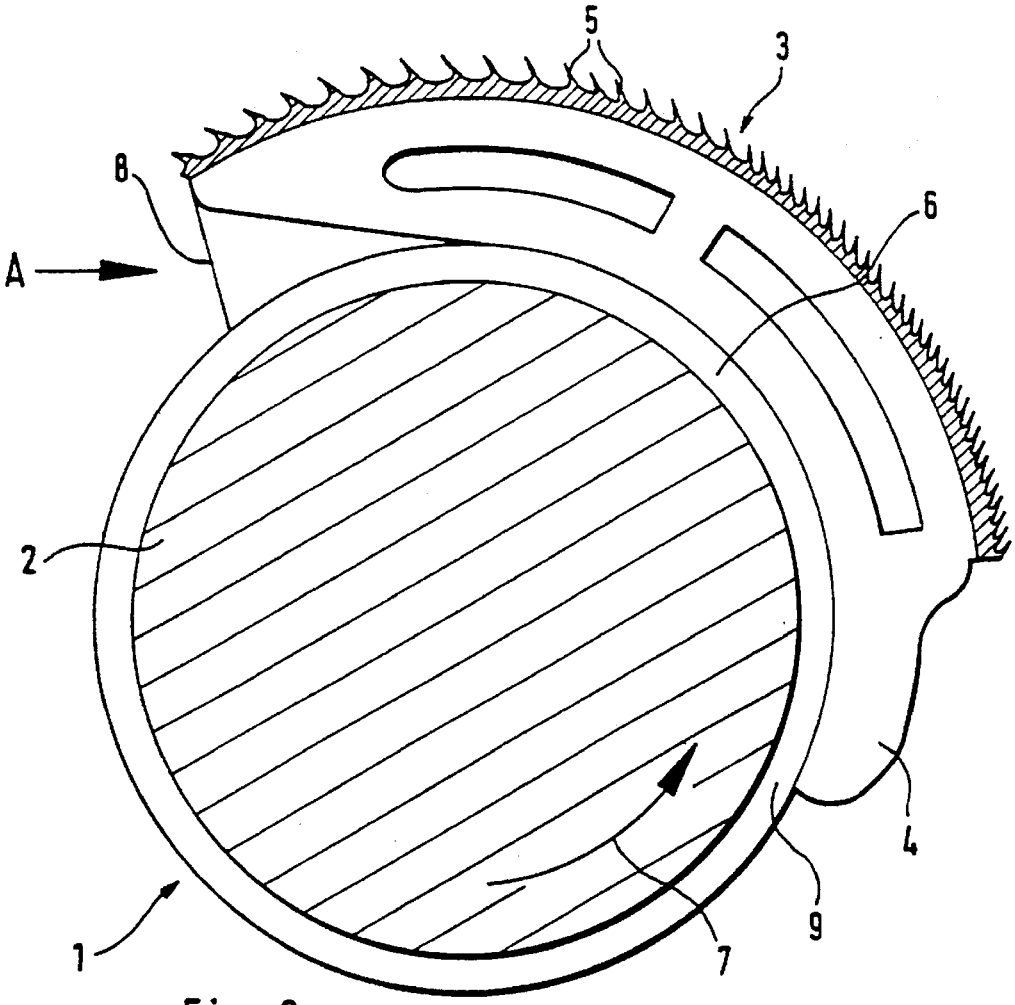
FIG. 3 shows a cross-sectional view of a second embodiment of the invention.
Figure 4:
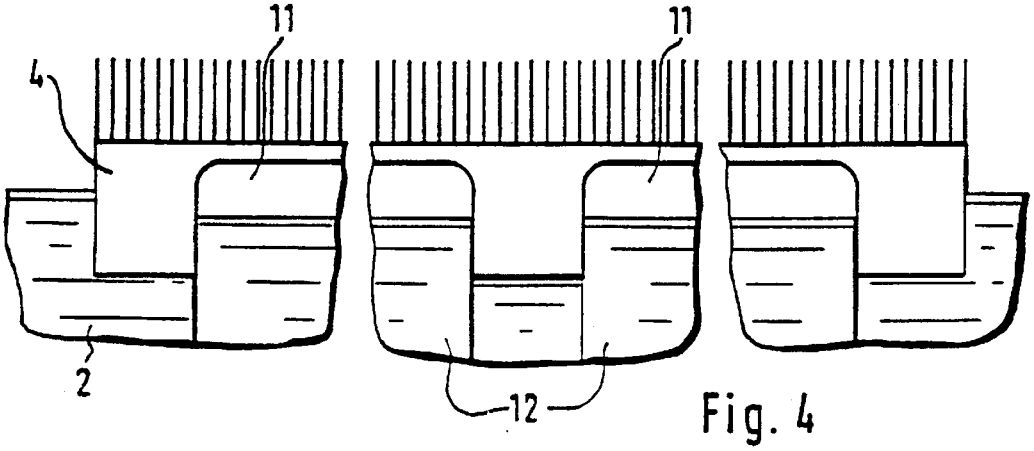
FIG. 4 shows a circular comb of FIG. 3 as viewed along arrow A in FIG. 3.

The embodiment shown in FIGS. 3 and 4 differs from that shown in FIGS. 1 and 2 by providing two channels between the comb member 3 and the support member 2. These channels are constituted by grooves 11 formed between ribs 10 of the base member 4 and grooves 12 arranged under the grooves 11 and being formed in the support member 2 of the circular comb 1.

The performance of this circular comb 1 does not differ from that discussed with reference to the circular comb shown in FIGS. 1 and 2.

This invention is not limited to those embodiments shown in the figures. For example, more than two channels can be formed in an inventive circular comb for the purpose of an effective pressure compensation. Further, the radial and/or axial width of these channels may increase in the rotational direction along their overall length.

I claim:

1. Circular comb comprising a cylindrical support member having a peripheral surface and a cylinder axis, the support member being rotatable around its cylinder axis and a comb member having tines and a base body extending around a part of the peripheral surface of the support member and being rotatable therewith, wherein at least one channel extending essentially in a circumferential direction of the support member and having a radial width and an axial width is provided beneath the tines of the comb member between the support member and the comb member said channel having a first orifice facing in a rotational direction of the support member and a second orifice facing in a direction opposite to the rotational direction of the support member, characterized in that at least one of the radial width and the axial width increases along the rotational direction of the combat least along a portion of the circumferential extension thereof.

2. The circular comb according to claim 1 characterized in that the tines of the comb member are formed by saw-toothed wire strips.

3. The circular comb according to claim 1, characterized in that the channel is formed by one of a groove provided in a radially inwardly positioned peripheral surface of the base body and a groove provided in the peripheral surface of the support member.

* * * * *